US007077068B1

(12) United States Patent
Agee

(10) Patent No.: US 7,077,068 B1
(45) Date of Patent: Jul. 18, 2006

(54) HEIGHT ADJUSTABLE TABLE

(75) Inventor: William Michael Agee, Cornelius, NC (US)

(73) Assignee: Baker Manufacturing Co., Inc., Pineville, LA (US)

( * ) Notice: Subject to any disclaimer, the term of this patent is extended or adjusted under 35 U.S.C. 154(b) by 277 days.

(21) Appl. No.: 10/353,853

(22) Filed: Jan. 28, 2003

Related U.S. Application Data

(63) Continuation-in-part of application No. 09/718,305, filed on Nov. 21, 2000, now Pat. No. 6,510,803, and a continuation-in-part of application No. 09/768,934, filed on Jan. 23, 2001, now Pat. No. 6,546,880.

(51) Int. Cl.
*A47B 9/00* (2006.01)

(52) U.S. Cl. ..... 108/147; 248/188.2

(58) Field of Classification Search ..... 108/147, 108/144.1, 146, 147.19, 50.01, 50.02; 248/188.5, 248/188.1, 162.1, 404; 312/196, 195, 223.6
See application file for complete search history.

(56) References Cited

U.S. PATENT DOCUMENTS

| | | | |
|---|---|---|---|
| 544,836 | A | 8/1895 | Vetter |
| 1,243,750 | A | 10/1917 | Miller |
| 2,532,342 | A | 12/1950 | Sloane |
| 2,642,996 | A | 6/1953 | Oeler et al. |
| 2,982,050 | A | 5/1961 | May |
| 3,140,559 | A | 7/1964 | Grow et al. |
| 3,213,809 | A | 10/1965 | Kritske |
| 3,273,517 | A | 9/1966 | Amthor, Jr. et al. |
| 3,364,881 | A | 1/1968 | Kooi |
| 3,638,584 | A | 2/1972 | Cisler et al. |
| 3,820,176 | A | 6/1974 | Feiertag |
| 3,887,155 | A | 6/1975 | Bertalot |
| 3,908,560 | A | 9/1975 | Homer |
| 4,130,069 | A | 12/1978 | Evans et al. |
| 4,360,180 | A | 11/1982 | Bruneau |
| 4,469,029 | A | 9/1984 | Ramond |
| 4,591,214 | A | 5/1986 | Reuter et al. |
| 4,619,208 | A | 10/1986 | Kurrasch |
| 4,637,322 | A | 1/1987 | Hampshire et al. |

(Continued)

FOREIGN PATENT DOCUMENTS

| | | | |
|---|---|---|---|
| NL | 8801-157 | A | 1/1989 |

*Primary Examiner*—Jose V. Chen
(74) *Attorney, Agent, or Firm*—Garvey, Smith, Nehrbass & North, L.L.C.; Charles C. Garvey, Jr.

(57) ABSTRACT

A height adjustable table includes a frame that has a pair of spaced apart, generally vertical frame sections, each supported upon a foot, a transverse, generally horizontal section that connects at its end portions to the vertical sections and a pair of lifts that are supported by the vertical frame sections to elevate between extended, higher elevational and retracted, lower elevational positions. The lifts support a table top with a work surface. The frame can be in the form of a universal base that accepts a number of different mechanism including, for example, a counterbalance mechanism, a motor drive mechanism, and a manually operable mechanism. These mechanisms can be selected by a user, depending upon the type of table that is to be manufactured. A plurality of panels are provided that cover the frame. These panels can also be selected by an end user to define an ornamental look and/or a selected color pattern. A superstructure extends from the frame upwardly to support a storage unit (e.g., cabinet, shelve, receptacle) at a position above the work surface.

44 Claims, 6 Drawing Sheets

U.S. PATENT DOCUMENTS 4,751,884 A 6/1988 Ball
4,981,085 A 1/1991 Watt
5,041,770 A 8/1991 Seiler et al.
5,094,174 A * 3/1992 Grund et al. ..... 108/153.1
5,183,319 A * 2/1993 Pearson et al. ..... 312/196
5,289,782 A 3/1994 Rizzi et al.
5,322,025 A 6/1994 Sherman et al.
5,323,695 A 6/1994 Borgman et al.
5,339,750 A 8/1994 Smies
5,370,063 A 12/1994 Childers
5,394,809 A 3/1995 Feldpausch et al.
5,400,721 A 3/1995 Greene
5,408,940 A 4/1995 Winchell
5,447,099 A 9/1995 Adams et al.
5,544,593 A * 8/1996 Canfield et al. ..... 312/196
5,546,873 A 8/1996 Conner et al.
5,598,788 A 2/1997 Jonker
5,601,037 A 2/1997 Meyer et al.
5,685,231 A 11/1997 Eyre
5,706,739 A 1/1998 Shaheen et al.
5,752,448 A 5/1998 Eyre
5,778,799 A 7/1998 Eyre
5,797,331 A 8/1998 Watt
5,819,669 A 10/1998 Eyre
5,845,590 A 12/1998 Seidl
5,941,182 A 8/1999 Greene
6,026,755 A 2/2000 Long
6,062,148 A 5/2000 Hodge et al.
6,119,605 A 9/2000 Agee
6,119,989 A 9/2000 Hollington et al.
6,510,803 B1 1/2003 Agee
6,546,880 B1 4/2003 Agee

* cited by examiner

HEIGHT ADJUSTABLE TABLE

CROSS-REFERENCE TO RELATED APPLICATIONS

This is a continuation-in-part of U.S. Ser. No. 09/718,305, filed Nov. 21, 2000, now U.S. Pat. No. 6,510,803, and hereby incorporated herein by reference.

This is also a continuation-in-part of U.S. Ser. No. 09/768,934, filed Jan. 23, 2001, now U.S. Pat. No. 6,456,880, hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to adjustable tables, more particularly, tables having a work surface that can carry heavy objects and yet be adjusted into multiple elevational positions. Even more particularly, the present invention relates to an improved adjustable height table having an internal base that can accept different panels to give the table an alternate ornamental appearance if desired.

2. General Background of the Invention

Adjustable tables have been in use for many years. There are several adjustable height tables that are commercially available. Several of these adjustable height tables were patented as drafting tables. Several of these patents and commercially available tables were sold under the trademark Hamilton.

One of the primary uses for adjustable height tables is the support of a heavy object such as a computer and/or monitor at a comfortable elevation for the user. Because computers and monitors are relatively heavy, a problem exists when the table is at a maximum elevational position such as when the user chooses to stand. In such a situation, adjustable height tables can become top heavy and suffer from lateral instability. The weighted table top of the table tends to deflect when it is elevated to a high position and when it is loaded with a heavy object such as a monitor, computer or the like.

Many patents have issued that are directed to elevating or height adjustable tables. Examples include patents relating to Hamilton® drafting tables that have been sold for many years (see U.S. Pat. Nos. 3,140,559 and 3,273,517).

Early patents that show adjustable height tables are shown for example in U.S. Pat. Nos. 544,836; 1,243,750; 2,532,342; and 2,642,996;

The May patent discloses an adjustable support for a drafting table. In the May U.S. Pat. No. 2,982,050, an adjustable drafting board support that includes a pair of links that swing to elevate and lower the board and an improved arrangement for counterbalancing the board to apply a substantially uniform lift to the board in all operative positions.

The Grow U.S. Pat. No. 3,140,559 discloses a drafting table that uses a rack and pinion arrangement in combination with a locking or braking mechanism which is adapted to lock the vertically adjustable table in any selected position when the operating linkage has been released and which lock will become even more securely locked upon the application of downward pressure on the table top occurring in normal use.

The Kooi U.S. Pat. No. 3,364,881 discloses a drafting table with a single pedal control of both vertical movement and tilting.

U.S. Pat. No. 3,638,584 discloses a drafting table that includes a pedestal, support columns associated with the pedestal for vertical movement and a drafting board on an upper portion thereof. An elevating table is disclosed in the Feiertag U.S. Pat. No. 3,820,176.

A telescoping support arm of quadrangular cross-section is disclosed in the Bertalot U.S. Pat. No. 3,887,115. The apparatus provides roller bearings in corner spaces between each tube surrounding each other, the rollers in one corner rolling over separate braces supported on resilient means urging the rollers and the inner tube toward the other corner so as to exclude backlash.

The Horner U.S. Pat. No. 3,908,560 discloses a counter balancing system for a drafting table.

A vertically adjustable drafting table is disclosed in the Evans U.S. Pat. No. 4,130,069.

The Raymond U.S. Pat. No. 4,469,029 discloses a workstation comprised of support legs with a stable support base and the uprights on which pivoting elbows are adapted to form adjacent arms which are positioned and locked in place in an adjustable angular manner at one of these end of the arms, the other end bearing supports are work tops positioned and locked in place in a manner which can be angularly adjusted at will, so that these supports or work tops allow effects and uses which are multiple and can be combined together.

U.S. Pat. No. 4,591,214 issued to Reuter discloses a cabinet closure assembly that includes a panel which is pivotable between opening-blocking and opening-unblocking positions. The Kurrasch U.S. Pat. No. 4,619,208 discloses a work surface height adjustment mechanism.

An adjustable computer work table is disclosed in U.S. Pat. No. 4,637,322. Vertically actuating scissor arms are provided for moving the support shaft upward and downward whereby providing a vertical adjustment.

The Ball U.S. Pat. No. 4,751,884 discloses a height adjustable work top. The work top is adjustable and may tilt about a horizontal axis near the front edge. The work top may be mounted in an open office beam system or an office screen or partition in cantilever fashion or it may be a free standing unit.

A table lift mechanism is disclosed in the Watt U.S. Pat. No. 4,981,085. The '085 patent discloses furniture having a top or the like supported for vertical movement by telescoping legs supports with a counter balance for exerting a relatively uniform counter balance force from the top throughout its range of vertical movement. A latch mechanism is provided for latching the top in the selected vertical positions, and an adjustable roller guide mechanism as provided for coupling the telescoping elements of the legs supports.

An apparatus for adjusting a computer work station to individual needs is disclosed in the Seiler U.S. Pat. No. 5,041,770.

An adjustable height table is disclosed in the Rizzi U.S. Pat. No. 5,289,782. The '782 patent discloses a table having a top that can be vertically adjusted to various heights by a pair of telescoping legs and a counter balance weight mechanism which includes a weight box and weights that can be easily added or removed by the user depending on the weight carried by the table top. A locking mechanism including a spring urged threaded half nut and a stationary threaded rod enables the table top to be locked in place once a desired height is achieved.

An adjustable dual work surface support is disclosed in the Sherman, et al, U.S. Pat. No. 5,332,025. The Borgman, et al, U.S. Pat. No. 5,323,695 discloses a method of using a work station having separate and back tops having separate power drive arrangements while permitting independent height adjustment. A controller, which is programed by an operator, permits storage of a number of predetermined height locations each defining distinct heights for the tops. The operator effects programed movement of the tops to predetermined height locations for predetermined times in a predetermined sequence, with the rear top moving initially and a front top moving thereafter.

The Smies U.S. Pat. No. 5,339,750 discloses an adjustable work table. The '750 patent table comprises a base and at least one movable extensible vertical column attached to the base having a table top carried on the vertical column. A pivot is provided for moving the table top into any of a range of pivoted positions, preferably on both sides of the horizontal position of the table top. A motor is provided for holding the table top in any of the range of pivoted positions.

A non-binding cantilevered table lifting device disclosed in the Childers U.S. Pat. No. 5,370,063.

The Winchell U.S. Pat. No. 5,408,940 discloses an adjustable height work surface with rack and pinion arrangements.

The following table provides a list of additional patents that are known to applicant and that relate at least generally to height adjustable tables:

TABLE 1

| Pat. No. | Title | Inventor |
|---|---|---|
| 3,213,809 | Adjustable Table and Brake Mechanism Therefor | Kritske |
| 5,394,809 | Adjustable Height Table | Feldpausch et al. |
| 5,447,099 | Height Adjustment Mechanism for Tables | Adams et al. |
| 5,546,873 | Furniture worksurface Unit and Method | Conner et al. |
| 5,706,739 | Height Adjustable Counterbalance Workstation | Shaheen et al. |
| 6,062,148 | Height Adjustable Support for Computer Equipment and the Like | Hodge et al. |
| 6,119,989 | Support Assembly with a Storable Foot Support | Hollington et al. |
| NL 8801-157 | Height-Adjustable Office Table | Jan. 12, 1989 |

All of the patents listed in the above table and are hereby incorporated herein by reference.

BRIEF SUMMARY OF THE INVENTION

The present invention provides an improved, height adjustable table apparatus that includes a frame that has a pair of spaced apart generally vertical frame sections and a generally horizontal section that connects at its end portions to the vertical sections. A pair of feet are provided for supporting the respective vertical frame sections.

A pair of lifts are supported by the vertical frame section, each lift being supported by one of the vertical frame sections.

A table top is supported by the lifts so that the table top can be raised or lowered to a selected elevational position such as, for example, when a user has equipment on the work surface such as a computer.

A mechanism is fitted to the frame and includes a drive that elevates the lifts relative to the frame and thus the table top.

A plurality of panels are provided that removably cover the frame, wherein the panels include two separate interlocking panel sections that cover each vertical frame section, a horizontal panel that covers the horizontal section and sections that cover the feet.

The plurality of panels thus preferably include vertical panels, horizontal panels, and interlocking portions that join at least some of the panels together.

The frame is configured to receive a selected mechanism of a plurality of different mechanisms.

One of the mechanisms can be a counterbalanced spring mechanism. One of the mechanisms can include a motor drive. One of the mechanisms can be a manually operable mechanism such as a crank mechanism.

The mechanism can include a rotary shaft that is rotatable such as for example, manually rotatable or driven by the motor drive.

A superstructure can provide upper and lower end portions, the lower end portion being attached to the frame and supported by the frame. The upper end portion of the superstructure extends above the work surface even when the work surface is in the fully elevated position. The superstructure can be used to support an upper cabinet, storage unit, receptacle, shelving or the like.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
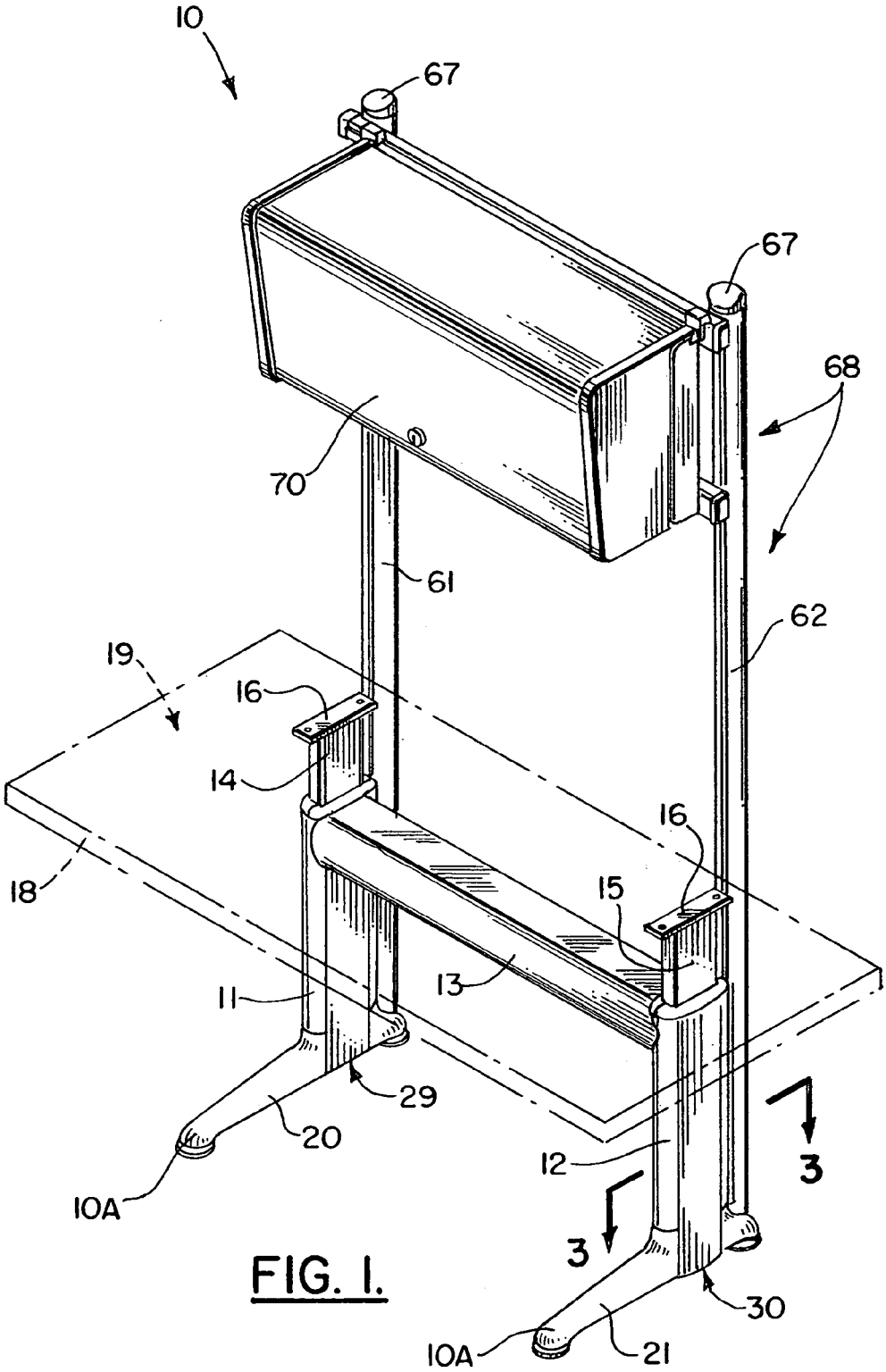
FIG. 1 is a perspective view of the preferred embodiment of the apparatus of the present invention.

FIGS. 1–8 show the preferred embodiment of the apparatus of the present invention designated generally by the numeral 10 in FIG. 1. Table apparatus 10 includes a base 10A having left fixed support 11 and right fixed support 12. The base 10A is a universal base that can be fitted with a selected mechanism of a plurality of mechanisms. In the preferred embodiment, these mechanisms can include, for example, a counterbalance spring mechanism, a motor driven mechanism, and a hand crank manually operable mechanism. These mechanisms are shown in U.S. Ser. No. 09/718,305, filed Nov. 21, 2000, now U.S. Pat. No. 6,510, 803, and hereby incorporated herein by reference.

The base 10A includes left and right fixed vertical supports 11 and 12 that are spaced apart and held in spaced relationship by a horizontal support or transverse structure 13. Base 10A can be of welded steel construction.

A pair of spaced apart lifts 14, 15 define an elevating portion that moves up and down with table top 18 having work surface 19.

Each of the lifts 14, 15 provides a lower end. Each of the lower end portions preferably carries a foot 20, 21 respectively.

Plates 16 are provided at the upper end portion of each lift 14, 15. Plates 17 are provided at the lower end of each of the fixed supports 11, 12. These plates 16, 17 have openings that enable the frame 11 to be attached (for example bolted) to spaced apart feet 20, 21 and to table top 18. The feet 20, 21 can be provided with casters 22.

A mechanism 60 is provided for assisting a user in the elevating or lowering of table top 18 during use. The mechanism 60 can include for example a counter balance spring mechanism, a motor drive, or a hand crank. Thus, the frame that includes supports 11, 12 transverse structure 13 and lifts 14, 15 with table top 18 is configured to accept a plurality of different mechanisms depending upon selection by a user.

Openings 73 in each plate 16 enable fasteners such as wood screws or bolts to attach table top 18 to lifts 14, 15. Table top 18 provides a work surface 19 that can be used to support any of a number of heavy objects such as a computer, computer monitor, books or other published material or the like.

Plates 17 at the lower end of each vertical support 11, 12 of base 10A enable fasteners 51 such as assembly screws or bolts/bolted connections to be used to fasten each of the feet 19, 20 to respective vertical fixed support sections 11, 12 of base 10A. Openings 74 in each of the feet 20, 21 at plate 29 receive assembly screws 51 upon assembly of the feet 20, 21 to the respective vertical supports 11, 12 at plates 17.

Figure 10:
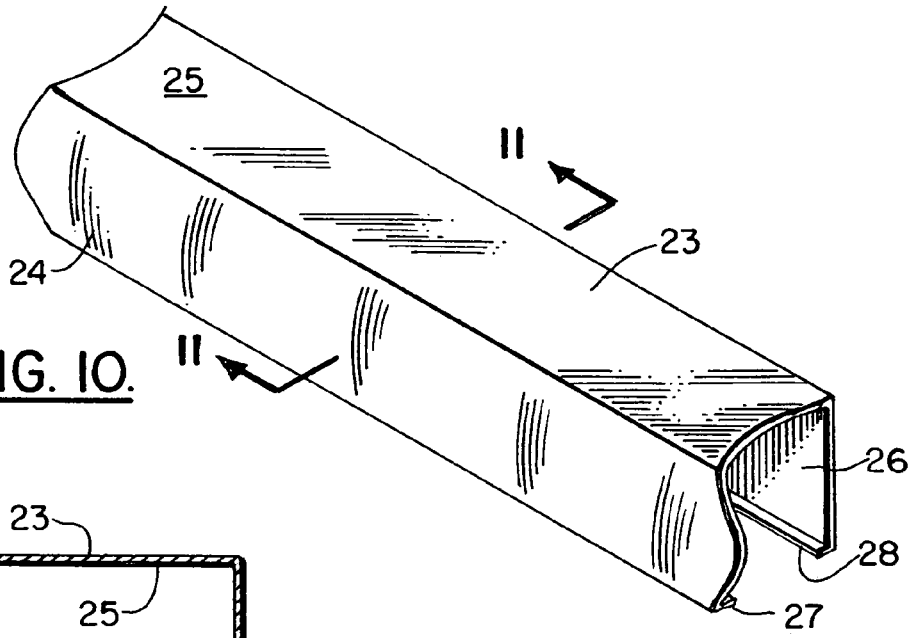
FIG. 10 is a fragmentary perspective view of the preferred embodiment of the apparatus of the present invention illustrating the transverse structure.
Figure 11:
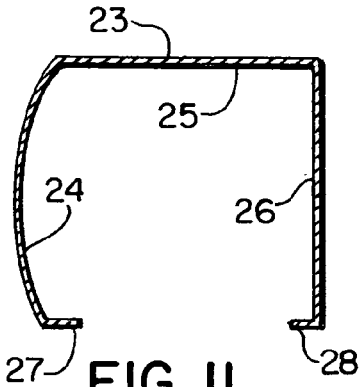
FIG. 11 is a sectional view taken along lines 11—11 of FIG. 10.
Figure 12:
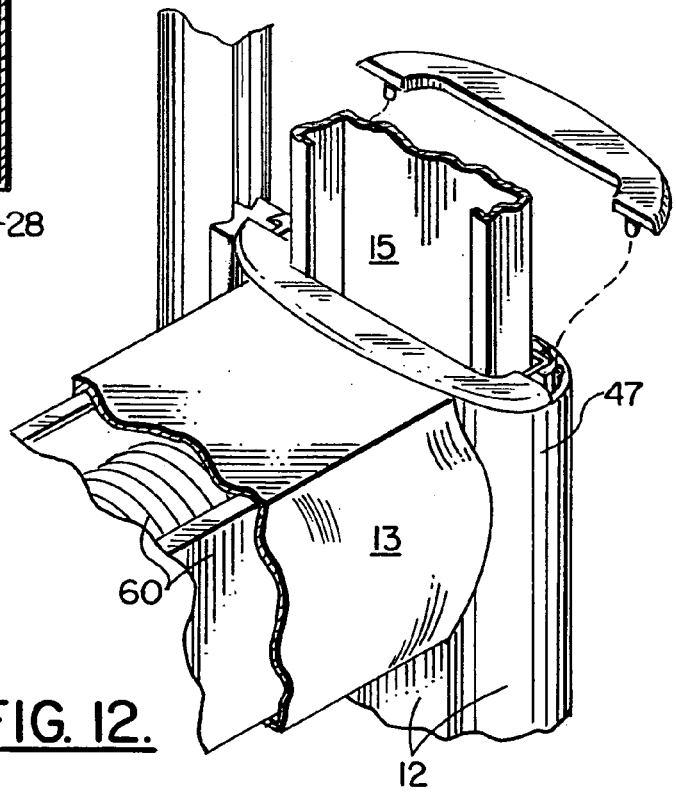
FIG. 12 is a fragmentary perspective view of the preferred embodiment of the apparatus of the present invention illustrating the transverse structure, a mechanism, and one of the fixed supports and its elevating lift.

The transverse structure 13 can be covered with a removable transverse cover or panel 23 that is shown in FIGS. 10, 11 and 12. Transverse cover 23 includes a front panel 24, a top panel 25, and a rear panel 26. The front panel 24 and rear panel 26 provide flanges at 27, 28 respectively. These panels 24–26 can be flat, curved or shaped.

Figure 2:
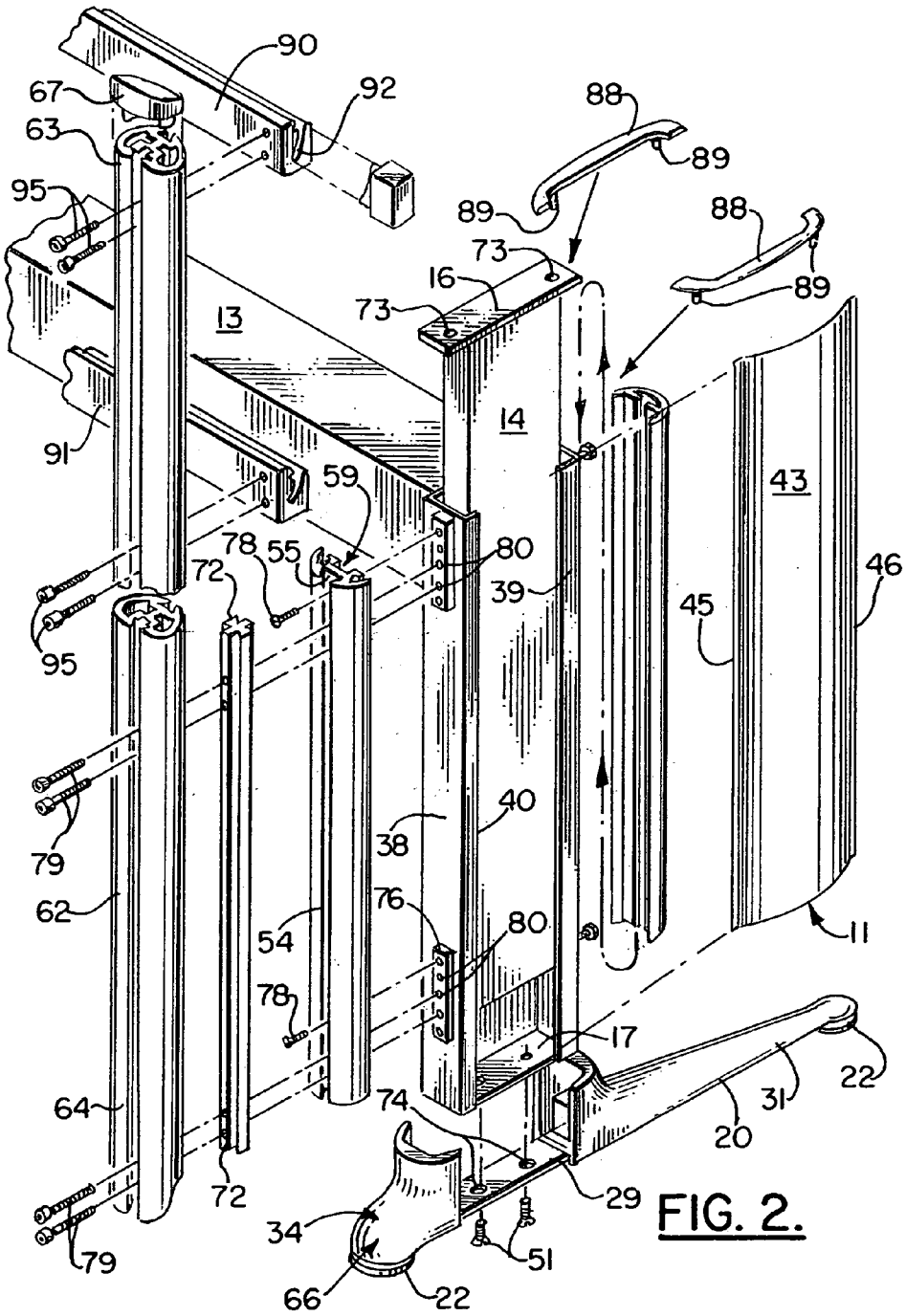
FIG. 2 is an exploded perspective view of the preferred embodiment of the apparatus of the present invention.

Each foot 20, 21 provides a base plate 29, 30 portion having opening 74. Plates 29 or 30 are attached to plates 17 of a fixed support 11, 12 using fasteners 51 as shown in FIG. 2. Feet 20, 21 are attached to plate 29 or 30 using fasteners 41 that engage internally threaded openings 42 (see FIGS. 4–7). In FIGS. 4–7, the feet 29 or 30 can be provided in differing sizes so that a customer can select a foot that has either a large toe section 31 and large heel section 32 or a small toe section 33 and small heel section 34. Any combination of the toe and heel sections shown in FIGS. 4–7 can be selected to construct a foot 20 or 21.

Figure 3:
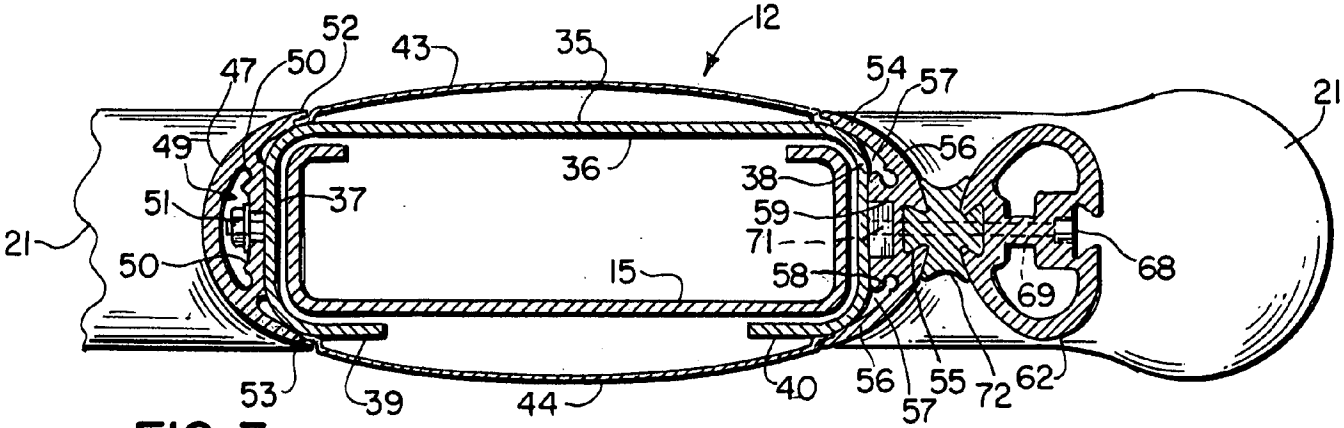
FIG. 3 is a sectional view taken along lines 3—3 of FIG. 1.
Figure 5:
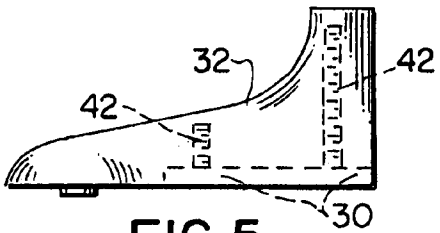
FIG. 5 is another fragmentary view of the preferred embodiment of the apparatus of the present invention.
Figure 4:
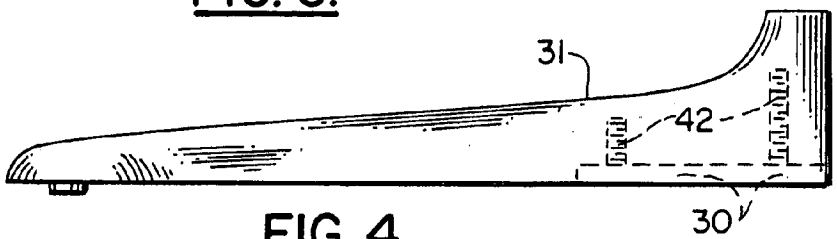
FIG. 4 is a fragmentary view of the preferred embodiment of the apparatus of the present invention.
Figure 7:
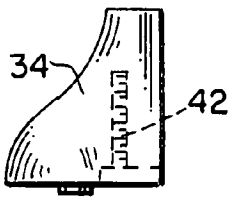
FIG. 7 is a fragmentary view of the preferred embodiment of the apparatus of the present invention.
Figure 6:
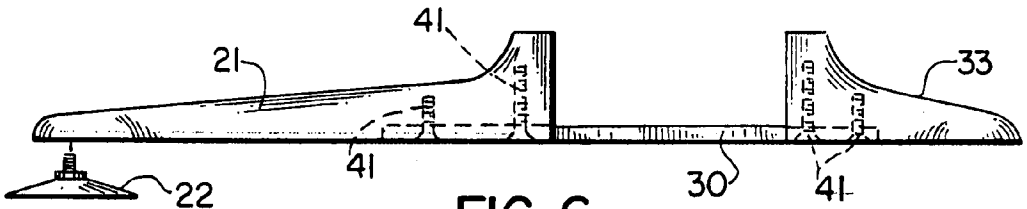
FIG. 6 is another fragmentary perspective view of the preferred embodiment of the apparatus of the present invention illustrating particularly the foot portion.

Each of the left 11 and right 12 fixed supports includes a fixed leg 35 that is comprised of a plurality of plate sections 36, 37, 38 and flanges 39, 40 (see FIG. 3). In FIG. 3, the right lift 15 can be shown contained within fixed leg 35 of right support 12.

Figure 13:
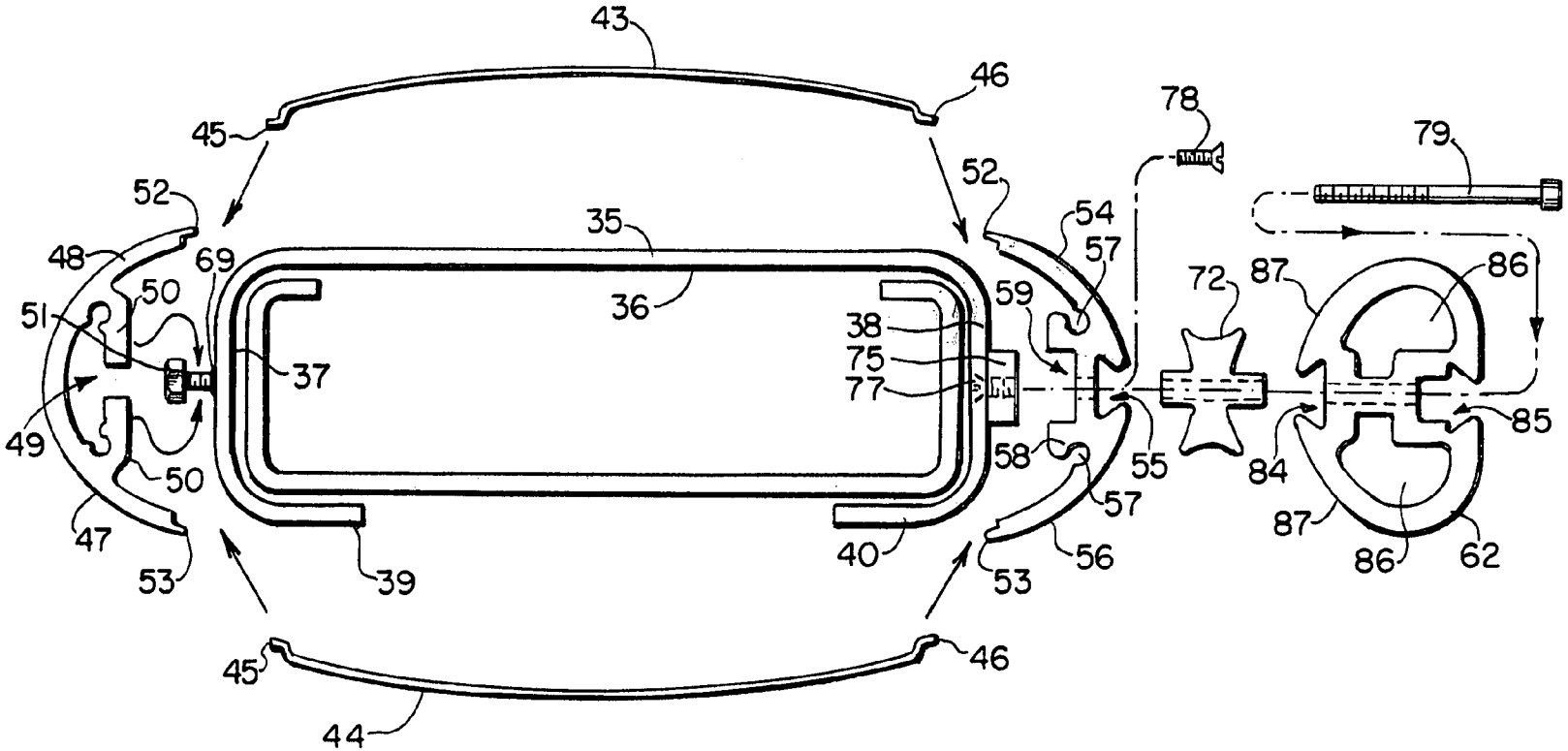
FIG. 13 is an exploded, fragmentary view of the preferred embodiment of the apparatus of the present invention.

A pair of side panels 43, 44 are attached to right fixed support 12 using forward retainer 47 and rear retainer 54. In FIGS. 3 and 13, each side panel 43, 44 has a pair of edges 45, 46 that are shaped to fit under the overlapping edges 52, 53 of forward retainer 47 and rear retainer 54.

Forward retainer 47 includes an outer curved section 48, a void space 49 and an inner section 50 as shown in FIGS. 3 and 13. Rear retainer 54 has a vertical slot 55, outer curved sections 56 and a pair of void spaces 57. Inner section 58 provides a vertical slot 59 that fits over mounting blocks 75, 76.

An elevating mechanism 60 can be in the form of an electric motor, manual crank, or counter balance spring mechanism. The mechanism 60 lifts the left and right lifts 14, 15 with respect to the fixed legs 35 of left and right fixed supports 11, 12.

A superstructure 68 is provided that supports a selected storage unit such as a cabinet 70. In the preferred embodiment, the superstructure includes a pair of columns 61, 62. Each column 61, 62 has an upper end portion 63 and a lower end portion 64. The lower end portion 64 of each column 61, 62 has a shaped surface 65 that fits against and conforms to the shaped surface 65 of the heel section 34 or 32. The upper end portion 63 of each column 61, 62 can be fitted with a cap 67. A semicircular cut out 83 can be provided on table top 19, fitted with semicircular liner 81 to which cover 82 can be attached. Cover 82 is optionally removed when table apparatus 10 is to be provided with superstructure 68 and its columns 61, 62.

Mounting blocks 75, 76 shown in FIG. 2 are provided for holding rear retainer 54 in position next to plate 38 of fixed leg 35. Each mounting block 75, 76 includes multiple (preferably five) internally threaded openings 80. One or more screws or like fasteners 77 can extend through plate 38 as shown in FIG. 13 and engage one or more of the internally threaded openings 80 of mounting blocks 75, 76 for holding blocks 75, 76 to plate 38. Fastener 78 can be used to hold rear retainer 54 to mounting blocks 75, 76 and thus to plate 38. Fastener 79 can be used to secure columns 61, 62, gasket 72, and retainer 54 to mounting blocks 75, 76 as shown in FIGS. 2, 3 and 13. Fastener 51 can be attached to plate section 37 of fixed leg 35 using a connection 69 such as a welded connection. Cover plates 88 have pegs 89 that fit void spaces 49, 57 as shown in FIGS. 2 and 12.

Figure 8:
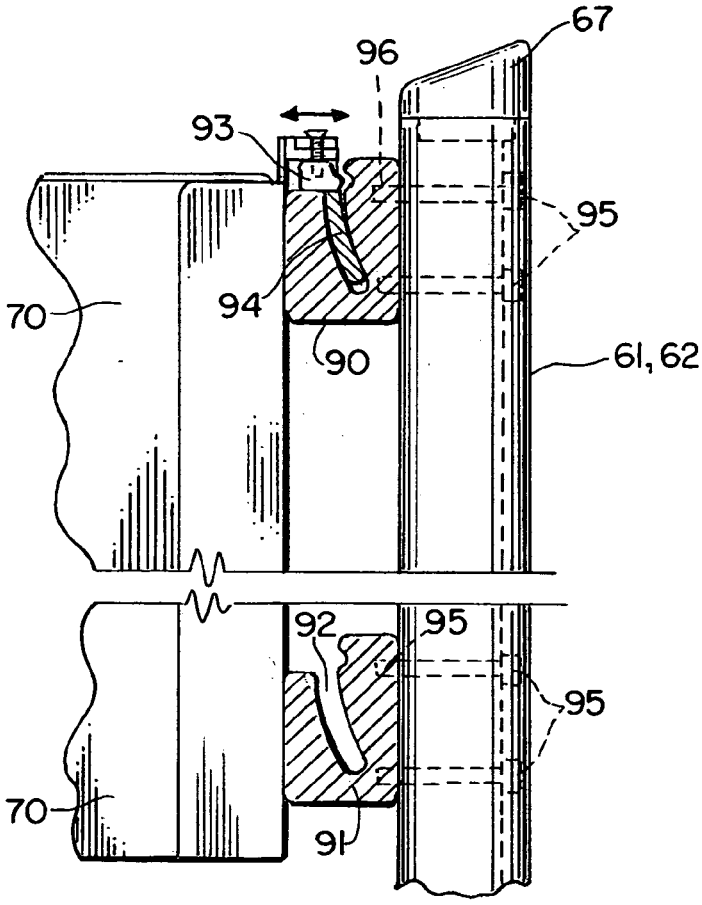
FIG. 8 is a sectional, fragmentary view of the preferred embodiment of the apparatus of the present invention.
Figure 9:
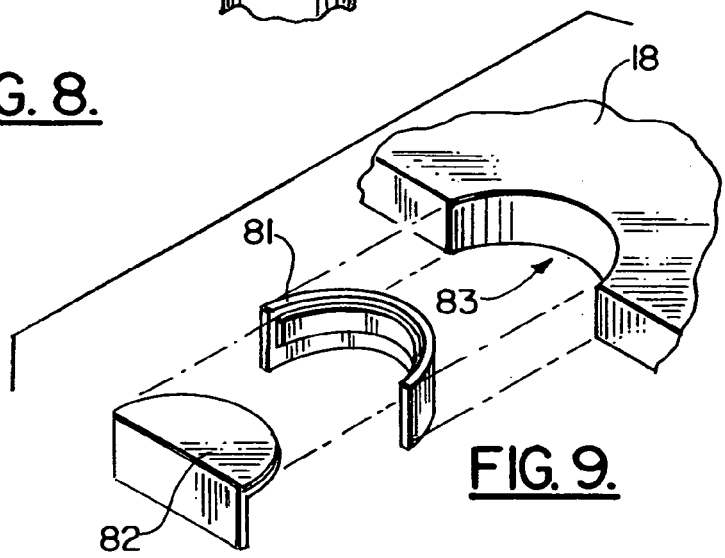
FIG. 9 is a fragmentary perspective view of the preferred embodiment of the apparatus of the present invention.

A storage unit such as cabinet 70 can be supported by the superstructure such as by column 61, 62 shown in FIGS. 1, 2 and 8.

Column 62 (and 61) has vertical slot 84 that receives gasket 72. Column 62 has vertical slot 85 that receives bolt 79. Column 62 also has curved surfaces 87 and void spaces 86. Gasket 72 fits into both vertical slot 84 of column 62 and vertical slot 55 of retainer 54 (see FIGS. 3, 13).

In FIGS. 1 and 8, cabinet 70 attaches to columns 61, 62 with upper support 90 and lower support 91. These supports 90, 91 can be extruded aluminum and provide an elongated slot 92. Hanger 93 can be fastened to cabinet 70. Each hanger 93 has an appendage 94 that fits slot 92. Hanger 93 is a commercially available fitting that is sold by Herman Miller, Inc. Bolts 95 engage openings 96 in support 90, 91 to secure them to columns 61, 62.

The following is a list of parts and materials suitable for use in the present invention:

Parts List

| Parts Number | Description |
|---|---|
| 10 | height adjustable table |
| 10A | base |
| 11 | left fixed support |
| 12 | right fixed support |
| 13 | transverse structure |
| 14 | left lift |
| 15 | right lift |
| 16 | upper mounting plate |
| 17 | lower mounting plate |
| 18 | table top |
| 19 | work surface |
| 20 | foot |
| 21 | foot |
| 22 | caster |
| 23 | transverse cover |
| 24 | front panel |
| 25 | top panel |
| 26 | rear panel |
| 27 | front flange |
| 28 | rear flange |
| 29 | base plate |
| 30 | base plate |
| 31 | large toe section |
| 32 | large heel section |
| 33 | small toe section |
| 34 | small heel section |
| 35 | fixed leg |
| 36 | plate |
| 37 | plate |
| 38 | plate |
| 39 | flange |
| 40 | flange |
| 41 | fastener |
| 42 | internal threaded opening |
| 43 | side panel |
| 44 | side panel |
| 45 | edge |
| 46 | edge |
| 47 | forward retainer |
| 48 | outer curved section |
| 49 | void space |
| 50 | inner section |
| 51 | fastener |
| 52 | overlapping edge |
| 53 | overlapping edge |
| 54 | rear retainer |
| 55 | vertical slot |
| 56 | outer curved section |
| 57 | void space |
| 58 | inner section |
| 59 | vertical slot |
| 60 | elevating mechanism |
| 61 | column |
| 62 | column |
| 63 | upper end portion |
| 64 | lower end portion |
| 65 | shaped surface |
| 66 | shaped surface |
| 67 | cap |
| 68 | superstructure |
| 69 | connection |
| 70 | cabinet |
| 71 | opening |
| 72 | gasket |
| 73 | opening |
| 74 | opening |
| 75 | mounting block |
| 76 | mounting block |
| 77 | fastener |
| 78 | fastener |
| 79 | fastener |
| 80 | opening |

-continued

Parts List

| Parts Number | Description |
|---|---|
| 81 | semicircular liner |
| 82 | cover |
| 83 | cut out |
| 84 | vertical slot |
| 85 | vertical slot |
| 86 | void space |
| 87 | curved surface |
| 88 | elongated cap |
| 89 | peg |
| 90 | upper support |
| 91 | lower support |
| 92 | slot |
| 93 | hanger |
| 94 | appendage |
| 95 | bolt |
| 96 | opening |

The foregoing embodiments are presented by way of example only; the scope of the present invention is to be limited only by the following claims.

The invention claimed is:

1. A height adjustable table apparatus, comprising:

a) a frame that includes a pair of spaced apart generally vertical fixed frame sections, each having outer surface and a transverse section that connects at its end portions to the vertical fixed frame sections;

b) a pair of movable lifts, each lift being supported by a vertical fixed frame section and each being movable between a lowered and an elevated position;

c) a table top supported by the lifts;

d) a frame supporting mechanism that elevates the lifts relative to the frame; and e) a plurality of removable panels that cover the outer surfaces of the vertical frame sections, wherein the removable panels include at least two separate interlocking panel sections that cover the outer surface of each vertical frame section, one of said panels being positioned below the transverse section of the frame.

2. The height adjustable table of claim 1 wherein the plurality of panels include vertical panels, horizontal panels, and interlocking portions that join the panels to the frame.

3. The height adjustable table of claim 1 wherein the frame is configured to receive a selected mechanism of a plurality of different mechanisms.

4. The height adjustable table of claim 3 wherein the mechanism includes a counterbalance spring.

5. The height adjustable table of claim 3 wherein the mechanism includes a motor drive.

6. The height adjustable table of claim 3 wherein the mechanism is manually operable.

7. The height adjustable table of claim 6 wherein the mechanism includes a rotary shaft that is manually rotatable.

8. The height adjustable table of claim 7 wherein the rotary shaft is rotatable using a hand crank.

9. The height adjustable table of claim 1 wherein the panels include a plurality of panel sections including at least one panel section that covers the transverse, generally horizontal section.

10. The height adjustable table of claim 1 further comprising columns connected to the frame behind the vertical frame sections and a cabinet that is supported upon the columns above the table top.

11. The height adjustable table of claim 1 further comprising a superstructure supported by the fixed vertical sections of the frame that extends above the table top.

12. The height adjustable table of claim 1 further comprising a shelf supported by the superstructure.

13. The height adjustable table of claim 1 further comprising a cabinet supported by the superstructure.

14. The height adjustable table of claim 1 further comprising a superstructure that is supported upon the frame and that extends above the work surface, the frame being positioned to support a storage unit above the table top.

15. A height adjustable table apparatus, comprising:

a) a frame having a frame outer surface, the frame including a pair of spaced apart generally vertical fixed frame sections, a transverse, generally horizontal section that connects at its end portions to the vertical sections;

b) a pair of lifts, each lift being movably supported by a fixed vertical frame section and movable between elevated and lowered positions;

c) a table top supported by the lifts and moving up and down with the lifts;

d) a mechanism that elevates the lifts relative to the frame; and e) a plurality of removable veneer panels that cover the frame outer surface including separate panels for covering at least part of the vertical and the horizontal sections at least one panel extending downwardly from the transverse section of the frame.

16. The height adjustable table of claim 15 wherein the panels include at least two separate interlocking panel sections that cover the outer surface of each vertical frame section.

17. The height adjustable table of claim 15 wherein the frame is configured to receive a selected mechanism of a plurality of different mechanisms.

18. The height adjustable table of claim 17 wherein the mechanism includes a counterbalance spring.

19. The height adjustable table of claim 17 wherein the mechanism includes a motor drive.

20. The height adjustable table of claim 17 wherein the mechanism is manually operable.

21. The height adjustable table of claim 17 wherein the mechanism includes a rotary shaft that is manually rotatable.

22. The height adjustable table of claim 21 wherein the rotary shaft is rotatable using a hand crank.

23. The height adjustable table of claim 15 wherein the panels include a plurality of panel sections including at least one panel section that covers the transverse, generally horizontal section.

24. The height adjustable table of claim 15 further comprising columns connected to the frame behind the vertical frame sections and a cabinet that is supported upon the columns above the table top.

25. The height adjustable table of claim 15 further comprising a superstructure supported by the frame that extends above the table top.

26. The height adjustable table of claim 25 further comprising a shelf supported by the superstructure.

27. The height adjustable table of claim 25 further comprising a cabinet supported by the superstructure.

28. The height adjustable table of claim 15 further comprising a superstructure that is supported at least in part by the fixed frame sections and that extends above the work surface, the frame being positioned to support a storage unit above the table top.

29. A height adjustable table apparatus, comprising:

a) a frame that includes a pair of spaced apart generally vertical fixed frame sections, each having outer surface and a transverse section that connects at its end portions to the fixed vertical sections;

b) a pair of movable lifts, each lift being supported by a fixed vertical frame section to move between a lowered and an elevated position;

c) a table top supported by the lifts and moving therewith;

d) the frame supporting mechanism that elevates the lifts relative to the frame; and e) a plurality of panels that cover the outer surfaces of the vertical frame sections, wherein the panels include at least two separate interlocking panel sections that cover the outer surface of each vertical frame section and including one panel that extends downwardly from the transverse section of the frame;

f) a superstructure having upper and lower end portions, the lower end portion being attached to the frame, the upper end portion including a storage unit.

30. The height adjustable table of claim 29 wherein the plurality of panels include vertical panels, horizontal panels, and interlocking portions that join some panels together.

31. The height adjustable table of claim 29 wherein the frame is configured to receive a selected mechanism of a plurality of different mechanisms.

32. The height adjustable table of claim 29 wherein the mechanism includes a counterbalance spring.

33. The height adjustable table of claim 29 wherein the mechanism includes a motor drive.

34. The height adjustable table of claim 29 wherein the mechanism is manually operable.

35. The height adjustable table of claim 29 wherein the mechanism includes a rotary shaft that is manually rotatable.

36. The height adjustable table of claim 29 wherein the rotary shaft is rotatable using a hand crank.

37. The height adjustable table of claim 29 wherein the panels include a plurality of panel sections including at least one panel section that covers the transverse, generally horizontal section.

38. The height adjustable table of claim 29 further comprising a shelf supported by the superstructure.

39. The height adjustable table of claim 29 further comprising a cabinet supported by the superstructure.

40. The height adjustable table of claim 29 wherein the superstructure includes a pair of spaced apart columns that are attached to the vertical fixed frame sections.

41. The height adjustable table of claim 40 wherein the storage unit is a cabinet.

42. The height adjustable table of claim 40 wherein the storage unit provides a shelf.

43. The height adjustable table of claim 40 wherein the storage unit is movable into different elevational positions relative to the columns.

44. The height adjustable table of claim 40 wherein the movable panels include forward, rear and side panels for each vertical frame section.

* * * * *